US007732011B2

(12) United States Patent
Gupta et al.

(10) Patent No.: US 7,732,011 B2
(45) Date of Patent: Jun. 8, 2010

(54) METHOD TO PRODUCE TONE-CONTROLLED COLORS IN COLORLESS CRYSTALS

(76) Inventors: Ram Pratap Gupta, 14, Sharma Colony, 22-Godam, Nandpuri, Jaipur (IN) 302019; Samir Gupta, 14, Sharma Colony, 22-Godam, Nandpuri, Jaipur (IN)

( * ) Notice: Subject to any disclaimer, the term of this patent is extended or adjusted under 35 U.S.C. 154(b) by 0 days.

(21) Appl. No.: 12/196,725

(22) Filed: Aug. 22, 2008

(65) Prior Publication Data

US 2009/0246370 A1 Oct. 1, 2009

(30) Foreign Application Priority Data

Mar. 31, 2008 (IN) ..... 796/CHE/2008

(51) Int. Cl.
*C23C 16/00* (2006.01)
*C30B 29/10* (2006.01)

(52) U.S. Cl. ..... 427/255.23; 427/255.21; 427/255.28; 501/86

(58) Field of Classification Search ..... 427/255.23, 427/255.21, 255.28
See application file for complete search history.

(56) References Cited

U.S. PATENT DOCUMENTS 6,872,422 B2 * 3/2005 Gupta et al. ..... 427/255.25
2007/0110924 A1 * 5/2007 Yelon et al. ..... 428/15

* cited by examiner

*Primary Examiner*—Frederick J Parker
(74) *Attorney, Agent, or Firm*—Donald R. Boys; Central Coast Patent Agency, Inc.

(57) ABSTRACT

The embodiments of present invention provide method for imparting tone-controlled colors into colorless crystals such as gemstones or decorative objects by coating a atomically mixed thin film comprising of a color causing reagent and a toner material onto the surface of colorless gemstones or transparent crystals and subjecting them to a heat treatment to produce colors of desired shades in the crystals. The method employed is radiation-free, eco-friendly and avoid the use of any hazardous material. The method highlights that controlling the amount of toner material could easily control the shade of color induced by the colorant material. The coating of atomically mixed single film onto the surface of crystals results in reduction of diffusion time significantly at a reasonable temperature, to impart colors to crystals such as gemstones and colorless decorative objects.

15 Claims, No Drawings

METHOD TO PRODUCE TONE-CONTROLLED COLORS IN COLORLESS CRYSTALS

BACKGROUND

1. Technical Field

The present invention relates to method for imparting colors and to control tone/shade of the imparted colors to colorless gemstones or decorative objects to obtain a desired shade of colors in the crystals. More specifically, the present invention relates to methods wherein tone of the imparted colors in colorless gems or crystals can be controlled. Even more specifically, the present invention relates to radiation-free, environment-friendly methods by which colored gemstones/crystals of desired color-tone can be produced.

2. Description of the Related Art

A variety of colored crystals are used in ornaments and decorative items. In recent years, the gems studded apparels are also becoming popular. Thus among minerals, the gem-crystals constitute an important class of mineral. About 2000 kinds of gem-minerals are available in nature, out of which around 100 are most popular. The cost and market demands of such minerals largely depend on their properties such as color, shine, transparency etc. and their over all appearance. The mother-earth provides both colored and colorless minerals. However, proportionately, colored crystals of the natural minerals such as gemstones are not available in large quantities compared to colorless ones. Therefore, the market demand of colored crystals is not met by the natural resources. Further, most of the colored gem minerals provided by the nature do not have aesthetically pleasing appearance. Therefore, a number of techniques have been invented to enhance their properties and to impart pleasing colors in colorless crystals.

Based on the scientific knowledge of color causing phenomena in natural gem crystals, a variety of techniques have been developed in the art to enhance the aesthetic properties of the colorless or paler gem minerals. The techniques such as electron, neutron, cobalt-60 irradiation, heat treatments, coating of multi layer, diffusion etc. have been developed to impart colors to transparent crystals particularly, colorless gem minerals.

For irradiation, Gamma reactors or Linear accelerators are employed to induce colors in colorless gems. U.S. Pat. No. 5,477,055, U.S. Pat. No. 4,749,869, U.S. Pat. No. 2,945,793 and many more describe different techniques to produce radiation treated colored gems. For intense color or for inducing colors in large size crystals a high dose with very high energy gamma rays are needed (U.S. Pat. No. 5,084,909). Radiation technique is widely used to produce colored gemstones for the past 50 years or so.

U.S. Pat. No. 3,490,250 describes a technique of multi layer coating of refractive materials on colorless gems. Starcke et al. (U.S. Pat. No. 5,853,826) also claimed a similar coating technique to improve colors of transparent materials. The coated crystals appear colored due to optical interference effect caused by reflection of light at interfaces of the deposited layers. A Japanese Patent JP60119506A2 also describes this method to produce color filters. To produce colored appearance in gemstones a technique based on joining a colored stone to a colorless gem has been described in Meisnner's patent U.S. Pat. No. 6,025,060. This patent teaches to produce colored composite gemstones. This approach has been followed in Signity America Ltd patent (WO 2007/123600 A1) to produce multiplet gemstones wherein a translucent printed image is embedded in between flat surfaces of two stones to obtain a composite, esthetically pleasant gem for use in jewelry. Thus instead of a colored piece as used in Meissner's technique, a custom image is inserted between two stones to produce a composite gem in Signity invention.

In recent past a technique based on diffusion evolved to impart colors to gem stones. Though the phenomenon of diffusion was known much earlier, however, the technique matured only after invention of semiconductor transistor in 1947. Semiconductor technologists developed a number of methods such as thermal diffusion, chemical vapour deposition (CVD), physical vapour deposition (PVD), ion-implantation etc. to accomplish diffusion in semiconductors to fabricate integrated circuit chips. Carr et al. (U.S. Pat. No. 3,897,529 are probably, the first ones to apply diffusion technique to enhance gems. Their subsequent patents U.S. Pat. No. 3,950,596 and U.S. Pat. No. 4,039,726, claim production of red, pink and blue colors in corundum by heating in powder of oxides of chromium, titanium, ferric and aluminium. Japanese Pat. No. 115998 and U.S. Pat. No. 2,690,630 also describe powder process to impart blue color in sapphire. Subsequently, it was recognized that diffusion of cobalt in sapphire is the cause of its blue coloration (Kane et al. Gems & Gemology, Summer 1990, 115-133). However, Shanon reported cobalt in blue colored minerals as early as in 1923 (American Mineralogist, vol. 8, No. 4, pp 147-148). In this technique colorless crystals in contact with powder of a color-causing reagent are heated at a temperature above 1300 degree Celsius to produce colors in them. Richard Pollak also applied the powder technique of Carr et. al to enhance color of topaz, quartz, garnet and chrysoberyl by heating them in fine powder of cobalt and cobalt oxide. U.S. Pat. No. 5,888,918 of Pollak employs a treatment temperature in the range of 900 degree Celsius to 1250 degree Celsius, which he further improved to 825 degree Celsius to 1050 degree Celsius according to his U.S. Pat. No. 6,376,031, U.S. Patent Appl. No. 20020174682 and WO 98/48944. However, in all these inventions a long treatment time between 3 hours to 200 hours is employed. According to U.S. Patent Appl. No. 20020128145, Pollak succeeded further in his efforts to reduce the treatment temperature range to 700 degree Celsius up to about 1000 degree Celsius but for a time period in the range of about 3 hours up to about 600 hours. The increase in treatment time according to this patent is understandable as those of skill in the art recognize that at low temperatures, long diffusion times are required to accomplish a process.

In a recent patent Gupta et al. (U.S. Pat. No. 6,872,422 B2) invented a technique to impart colors to gem minerals by diffusion. This patent employs coating of thin film of a colorant reagent followed by a heat treatment to produce colored gems. The technique provides better control on color intensity and significant improvement in treatment times to produce diffused colored gems. This thin film process claims a number of advantages over the powder methods.

Recently, Swarovski & Co. patent, (AT 411 464 B, 26, Jan. 2004) and Rauch et. al. patent (U.S. Pat. No. 7,033,640 B2, April 2006) report a technique wherein instead of use of powders of metal and metal oxides of Pollak's inventions discussed above, a sieve plate primarily made of cobalt and cobalt oxide (or iron oxide or vanadium oxide) with Aluminum oxide as an additive, has been employed to impart colors to gems. Their US patent, U.S. Pat. No. 7,033,640 B2 is English version of Oesterreich patent AT 411 464 B. However, the hitherto known processes of the mentioned inventions suffer from a number of drawbacks. Irradiation methods are limited in terms of cost, safety, efficacy and the like. Further, the radiated crystals are likely to loose their color in case they encounter exposure to a high temperature in their use. Though irradiation is a widely used technique for gems coloring and enhancement but one major concern of the radiation process is that the irradiated crystals (also named as "Nuked Stones") stay radio-active for up to a year or more. Geiger Mueller Counter is used to measure the reminiscent radiations in the irradiated gems. U.S. safe limit of reminiscent radiation is 1 nano-curie/gm and that of Asian is 2 nano-curie/gm. A 50 nano-curie emission from the stones is believed to cause skin cancer and destroy white blood cells.

A major disadvantage of multi layers coating technique is that this does not induce any color into the crystals. The crystals appear colored because of reflection and interference of light by the layers deposited on surface of the crystal. Further, exposure of these crystals to high temperature or to acids treatment during their use in ornament making or any other such use the coated crystals are likely to result in loss or change of their colors.

The techniques to produce composite gemstones as reported in U.S. Pat. No. 6,025,060 gives a product, which only appears colored, or a gem containing an image. This technique is also labor intensive and is not time effective.

As readily recognized by those of skill in the art of diffusion, that diffusion constant of an element is a strong function of temperature. Therefore, under generally recognized diffusion principles, one would not expect invention methods to work during the average human life at the moderate temperature. This can obviously be noted in Pollak's U.S. Patent Application No. 20020128145, that the reduction in diffusion temperature to 700 degree Celsius in this invention, the diffusion time has increased enormously to 600 hours. Such a long exposure to heat is not only expensive but also likely to cause damage to crystals body/surface. Further, such a long treatment time is similar to long cooling periods required for radiation treated gems and is one of the vital concerns for commercial production. The other major drawbacks associated with powder diffusion process are: additional thermal load of powder/s to the furnace; uneven coloration and color patches on the surface of the treated stones; occurrence of surface damages due to sticking of powder particles at high temperature; two step heating; acid cleaning and/or polishing after heat treatment to remove powder particles that get adhered to the treated stones; risk of surface damage in post cleaning of treated stones and safety precautions against handling of acids and nano sized powders. In a powder process, stones are buried in a powder of coloring reagent. Also to control color intensity, powder/s of diluting agent such as oxides of magnesium, aluminium etc. is also mixed with the colorant. Since an extremely small quantity of colorant is used for imparting color to stones, the diluting powder/s adds to thermal mass and take up a very great deal of furnace space. The uneven coloration or color patches in powder process is inherent as the surface of a crystal buried in colorant powder is not uniformly in contact with the powder particles. Further, the finite size (even powder particles are of nanometer in size) of powder particles inherently, result in some finite gap between two adjacent particles contacting the crystal surface. At such gaps the diffusion of colorant atoms is much less compared to that at contacting points on the stone surface. This therefore, leads to a non-uniform diffusion and thereby uneven coloration or color patches in the finished products. It is very well realized by those of expert in art that at high temperatures the powder particles stick a solid surface of the crystals and therefore, some cleaning or polishing treatment is always needed to regain the shine of the treated gems. Other economic concerns in Pollack's powder process are: two steps of heating (first with colorant powder and second with neutral powder), and cleaning of individual stones after heating with powder. All these drawbacks make the powder methods expensive and time consuming. The most important technical shortcoming of a powder process is that there is no intimate contact between the crystal and atoms of diffusing reagent. This necessitates either a higher temperature or a longer time for diffusion of atoms from the power into the host crystal. Perhaps this is why hundreds of heating hours are employed in Pollak's methods. Further, safety precautions to handle acids and particularly, finely divided particles are also other limitations of the powder processes. Threats posed by recently developed nano-materials to human health and environment has now become a major global concern.

Ref.(http:/news.nanoapex.com/modules.php?name=News&file=article&sid=3592) is offering research projects to study safety aspects for handling nano-material powders. The similar drawbacks of powder process have also been highlighted in the Rauch et al. patent U.S. Pat. No. 7,033,640 B2.

The Rauch et al. patent is a powder process as for preparation of a sieve plate powders are used. Also during conditioning of the sieve plate, a neutral powder is used to prepare the protective layer. Preparation of stone holding plate i.e. the sieve plate is a ceramic technology as metallic oxides are involved in this During heat treatment for conditioning of the plate in this method, cobalt atoms diffuse into the protective layer, which subsequently acts as a diffusion source for coloring the gemstones. Thus during treatment the colorant atoms are indeed in the vicinity of polished surface of the stones. The most important draw back of the process is that it is specific to gemstone shape and size. We know that in gem industries an enormous number of sizes and shapes are involved. To impart colors to all types of gems one has to prepare a large number of such sieve plates. Even if largest sized recesses are made in a plate to also treat smaller size stones, different plates are required for different shapes of gems. Further, the large size holes and spacing between them occupies more furnace space. The large sieve sized plates also reduce the number of stones for treatment per unit space of the furnace. It is evident from the claimed method that only the diffusion process is responsible for induction of colors in gems placed on the plate. It is well known through semiconductor technology that for diffusion to occur efficiently, the diffusing impurity has to be available in atomic form. And for this reason all diffusion processes in established semiconductor technology use impurities either in liquid or gaseous state or a solid source having high vapour pressure at a diffusion temperature. Metal/metal oxide plate used in Rauch et al process act as source of diffusing atoms for the stones in contact with the sieve body or the protective layer. Therefore, like in a powder process, in this method also there is no intimate contact between the gemstone surface and the coloring material. In this case also, the finite size of aluminium oxide powder used on the plate to provide a protective layer introduces a finite gap between the diffusing source and stones. This therefore is likely to lead to high treatment temperature or longer periods to diffusion to occur into the stones. In brief, this process involves cumbersome ceramic technology for preparation of sieve plates and incorporates most of the drawbacks of powder methods. Thin film based processes are backbone of modern semiconductor industries because these are highly reliable and reproducible. It is not appropriate to compare thin film based methods to ceramic technology at least in term of cleanliness and contamination.

Gupta et al. (U.S. Pat. No. 6,872,422 B2) invention uses colorant reagent in thin film form thus this does not add to the furnace load, thin film makes intimate contact to the crystal surface for efficient diffusion of coloring atoms in the crystal body, color intensity is controlled by thickness of the deposited film, no post cleaning is needed as all colorant material is consumed in imparting color to the stones and only one heating cycle for diffusion of the colorant atoms into gemstone is required. However, treatment cycle (heating time and temperature) of Gupta et al. process also employs temperature as high as 1200 degree Celsius and diffusion time as large as 10 hours.

When solid crystals are subjected to high temperatures and for a long duration at a particular temperature, they are likely to get damaged or break due to thermal effects. In powder processes of gem enhancement, Carr et al. (U.S. Pat. No. 3,897,529) employed 1750 degree Celsius. Pollak's invention succeeded in achieving the treatment temperature in the range of 700 degree Celsius to 1000 degree Celsius according to U. S. Pat. No. 20020128145. However, the treatment time increased form about 100 hours of Carr et al. methods to 600 hours in Pollak's processes. Gupta et al. (U.S. Pat. No. 6,872,422 B2) claimed gems enhancement at a temperature in the range of 700 to 1200 degree Celsius for a treatment time in the range between 30 minutes to 10 hours.

For the past 8 years our research is particularly focused on this aspect of the crystals coloration and the present invention is the result of that. We know that according to general theory of diffusion in solids, there is a limit on reduction of diffusion temperature as diffusion constant of an element is strongly temperature dependent. So if the temperature is reduced below a particular limit, the general theory of diffusion predicts that the diffusion process take very long time to get completed. Therefore, from practical point of view particularly, for production purpose a technology employing very low diffusion temperature is not advisable. For example, 600 hours of a treatment cycle according to U. S. Pat. No. 20020128145 needs 25 days to complete a treatment cycle and this may not be suitable to a production platform.

In Pollak's processes there are two major aspects that govern the treatment cycle. First, despite the use of finally divided powder (U. S. Pat. Appl. No. 20020174682 A1) there is always a finite gap between particles and also between particles and the stone surface. Since the in-diffusing atoms of the powder material require to travel this gap before they actually diffuse into the crystal, the long diffusion time is therefore necessary for completion of the treatment in a powder based diffusion process. Second important aspect that has been overlooked in the invented powder processes is related to use of compound/oxide as colorant reagent. The diffusion is an atomic process and for a diffusion to occur the compound/oxide molecules need to be broken into atoms to initiate the diffusion. The general chemical principles suggest that breaking of bonds require some specific amount of energy and thus more thermal energy is needed in case a compound/oxide is used as a diffusion source. Therefore, high temperatures or long diffusion times are inevitable in powder processes technology. In Gupta et al. processes, two or more layers (one over the other) of coloring materials are employed to produce different colors in gems. So even if a coloring material is not a compound, atoms of second layer material have to either travel through the thickness of first layer or have to wait till first layer is completely consumed in the crystal. This necessitates employment of longer diffusion time compared to a single layer process to accomplish the process.

Hence there is need to develop a method for imparting colors and to control tone/shade of the imparted colors to colorless gemstones or decorative objects to obtain a desired shade of colors in these crystals wherein optimum treatment cycle (heating time and temperature) is employed. There is a further need to develop a method wherein tone of the imparted colors in colorless gems or crystals can be controlled.

SUMMARY

The main objective of the present invention is to provide environment friendly methods for imparting colors to colorless crystals, which circumvent drawbacks of the hitherto known processes enumerated above.

Another object is to provide methods to produce colored crystals wherein optimum treatment cycle (heating time and temperature) is employed.

Yet another object is to provide methods to produce colored crystals, which are time and cost effective to be suitable for production purposes.

Yet another object is to provide methods by which a range of colors can be produced in colorless crystals.

Yet another object is to provide methods by which tone/shade of a color can easily be controlled.

Yet another object is to provide methods that are highly reproducible for imparting colors of desired tone/shade to transparent crystals such as gemstones and or the like.

Yet another object is to provide methods, which produce colors of highly uniform intensity in colorless crystals.

Yet another object is to provide methods, which do not produce any physical damage in crystal surface and do not require any kind of chemical or physical cleaning after treatment.

The embodiments of present invention provide method for imparting tone-controlled colors into colorless crystals such as gemstones or decorative objects by coating a atomically mixed thin film comprising of a color causing reagent and a toner material on colorless gemstones or transparent crystals and subjecting them to a heat treatment to produce colors of desired shades in the crystals. The methods employed are radiation-free, eco-friendly and avoid the use of any hazardous material. The method highlights that controlling the amount of toner material could easily control the shade of color induced by the colorant material. This concept of the present invention is not obvious even to the experts in the art, as it needs in-depth understanding of the diffusion mechanism and related physics in addition to experience in this field of gems enhancement. The atomic mixing and coating of a single film on the crystals results in reduction of diffusion time significantly at reasonable temperature for imparting colors to crystals such as gemstones. The method of imparting tone-controlled colors to colorless crystals/objects offers a number of advantages over the hitherto known processes.

In accordance with the present invention, the method for imparting tone-controlled colors into colorless crystals such as gemstones or decorative objects comprises of following steps:

Coating of an atomically mixed thin film comprising of a color causing reagent and a toner material/s on colorless polished gemstones/transparent crystals and subjecting them to a heat treatment to produce colors of desired tone/shades in these crystals. A wide variety of crystals can be treated through the present invention. Examples of suitable crystals (useful as gemstones/decorative articles) contemplated for uses herein include (but not limited to) gemstones such as corundum, silicates olivine, topaz, garnet, aluminum silicates as dalusites, disthene or mullites, cubic zirconia, quartz, sapphire, beryl, decorative objects (all colorless/transparent) and the like.

A variety of techniques can be employed in the practice of the present invention to coat an atomically mixed film of a colorant and toner materials on the polished crystals. Typically, physical vapour deposition, or chemical vapour deposition or any other technique known in thin film technology and the like can be used for this purpose. A wide variety of materials (only in element form) can be employed as a colorant reagent to deposit the atomically mixed thin film on crystal stones in the invention methods. Examples of such materials include transition metals as well as other metals, semiconductors, non-metals, which can induce a color into the crystals being treated.

A wide variety of elemental materials can be employed as a toner material in the film to control the tone/shade of color induced by colorant reagent in crystal stones in the invention methods. Examples of suitable materials include transition metals, Semiconductors, non-metals, which may or not induce a color into the crystals being treated. A variety of combinations of colorant reagent and toner material, comprising of at least one element capable of inducing color in the crystal are used in the atomically mixed film.

A technique capable of preparation of atomically mixed film of colorant and toner is employed to deposit on the colorless crystals for production of colors of pre-determined tone and shades. Imparted colors by the invention methods can be varied based on such variables as the particular gem crystal being treated, the particular material and or combination of materials, the conditions to which the crystals are subjected and the like. For example, a combination comprising of cobalt as a coloring reagent and iron as toner in the atomically mixed film impart black, brown and different shades of these colors in topaz, cubic zirconia, quartz, sapphire and the like. Varying the amount of iron content in the deposited film, the tone/shade of induced color can easily be controlled. Similarly, a wide range of cobalt containing combinations such as cobalt-nickel, or cobalt-titanium and the like in the atomically mixed films can be employed to vary shade and tone of blue to green or their mixed colors in the crystals. These combinations in atomically mixed film give commercially known colors such as Swiss, London, Baby, sky blue particularly in topaz and greens, and blues of different tones/shades in sapphire, quartz, cubic zirconia, quartz and the like.

Similarly, if the crystals are coated with colorant iron and toner titanium then yellow to reddish, yellow or pink of varying tones/shades yellow crystals can be produced Like wise using praseodymium, neodymium, tin and or the like as a toner with the colorant iron a range of yellow, or orange, or red colors can be induced in topaz, quartz, cubic zirconia, sapphire and or the like crystals.

A wide range of treatment conditions after deposition of atomically mixed films can be employed in the practice of present invention. Typically, conditions suitable to impart colors to crystals comprise subjecting the film-coated crystals to a heat treatment to a temperature in the range of about 700 degree Celsius up to about 1060 degree Celsius, for a time period in the range of about 30 minutes up to about 90 minutes. Normally, air or oxygen is employed as environment during heat treatment at ambient pressure. However, the film-coated crystals can optionally be subjected to an inert or a reducing atmosphere during heat cycle. For inert environment, nitrogen or argon or helium gases and the like can be used. Like wise for reducing-environment forming gas (a mixture of nitrogen-hydrogen) and the like is used. The heat treatment of coated crystals can also be carried out in vacuum to employ a non-oxidizing or a non-reducing ambient. The ambient conditions immensely affect the color saturation, intensity and fire of the treated crystals. Therefore, a suitable environment is employed during heat treatment to obtain the desired results.

While crystals can be used in the invention treatment methods without any special pre-treatment, it is presently desired that crystals employed in the practice of the invention be cleaned prior to deposition of the film. This is recommended here to only to remove grease or dust particles or the foreign contaminants from the surface of the crystals. Suitable cleaning methods are well known to those of skill in the art, and include washing in water, organic media, and the like.

Normally, long exposure times and/or high exposure temperatures enhance intensity and saturation of imparted color. However, either of these parameters at their increased value may cause cracks or breakage in crystals particularly if the untreated ones contain hidden defects. Since according to present invention, single film of atomically mixed materials in element form need optimum minimum temperature for diffusion and employs significantly low exposure times, the breakage problem has significantly reduced by the invented methods.

The colored crystals obtained after the treatment, according to the present invention do not require any physical or chemical cleaning and can be used directly as gemstones or for ornamental or decorative applications immediately after the treatment. As an example, one cycle of treatment needs about 12 hours to complete in the present invention methods.

In accordance with another embodiment of the present invention, the method employs atoms of a color-imparting and a toner, elements either diffuse from the film material into the surface thereof or chemically, get bonded to the surface atoms of the crystal. The diffused atoms of the color imparting and toner elements penetrate into the crystal and became a part of the crystal structure while in case when these atoms get chemically bonded to the surface atoms of the crystal, a transparent color film is formed over the crystal surface. Color imparting and toner materials contemplated include the elemental materials described hereinabove.

In accordance with yet another embodiment of the present invention, the skin depth of the surface of the said crystal/gemstone has chemically bonded there to both color-imparting and toner elements in the film of atomically mixed materials. The color-imparting film materials contemplated include the materials described hereinabove. The color toner materials in film contemplated include the materials described hereinabove.

DETAILED DESCRIPTION

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments of present invention provide method for imparting tone-controlled colors into colorless crystals such as gemstones or decorative objects by coating a atomically mixed thin film comprising of a color causing reagent and a toner material on colorless gemstones or transparent crystals and subjecting them to a heat treatment to produce colors of desired shades in the crystals. The methods employed are radiation-free, eco-friendly and avoid the use of any hazardous material. The method highlights that controlling the amount of toner material could easily control the shade of color induced by the colorant material. This concept of the present invention is not obvious even to the experts in the art, as it needs in-depth understanding of the diffusion mechanism and related physics in addition to experience in this field of gems enhancement. The atomic mixing and coating of a single film on the crystals results in reduction of diffusion time significantly at reasonable temperature for imparting colors to crystals such as gemstones. The method of imparting tone-controlled colors to colorless crystals/objects offers a number of advantages over the hitherto known processes.

In accordance with the present invention, the method for imparting tone-controlled colors into colorless crystals such as gemstones or decorative objects comprises of following steps:

Coating of an atomically mixed thin film comprising of a color causing reagent and a toner material/s on colorless polished gemstones/transparent crystals and subjecting them to a heat treatment to produce colors of desired tone/shades in these crystals. A wide variety of crystals can be treated through the present invention. Examples of suitable crystals (useful as gemstones/decorative articles) contemplated for uses herein include (but not limited to) gemstones such as corundum, silicates olivine, topaz, garnet, aluminium silicates as dalusites, disthene or mullites, cubic zirconia, quartz, sapphire, beryl, decorative objects (all colorless/transparent) and the like.

A variety of techniques can be employed in the practice of the present invention to coat an atomically mixed film of a colorant and toner materials on the polished crystals. Typically, physical vapour deposition, or chemical vapour deposition or any other technique known in thin film technology and the like can be used for this purpose. A wide variety of materials (only in element form) can be employed as a colorant reagent to deposit the atomically mixed thin film on crystal stones in the invention methods. Examples of such materials include, transition metals as well as other metals, semiconductors, non-metals, which can induce a color into the crystals being treated.

A wide variety of elemental materials can be employed as a toner material in the film to control the tone/shade of color induced by colorant reagent in crystal stones in the invention methods. Examples of suitable materials include transition metals, Semiconductors, non-metals, which may or not induce a color into the crystals being treated. A variety of combinations of colorant reagent and toner material, comprising of at least one element capable of inducing color in the crystal are used in the atomically mixed film.

A technique capable of preparation of atomically mixed film of colorant and toner is employed to deposit on the colorless crystals for production of colors of pre-determined tone and shades. Imparted colors by the invention methods can be varied based on such variables as the particular gem crystal being treated, the particular material and or combination of materials, the conditions to which the crystals are subjected and the like. For example, a combination comprising of cobalt as a coloring reagent and iron as toner in the atomically mixed film impart black, brown and different shades of these colors in topaz, cubic zirconia, quartz, sapphire and the like. Varying the amount of iron content in the deposited film, the tone/shade of induced color can easily be controlled. Similarly, a wide range of cobalt containing combinations such as cobalt-nickel, or cobalt-titanium and the like in the atomically mixed films can be employed to vary shade and tone of blue to green or their mixed colors in the crystals. These combinations in atomically mixed film give commercially known colors such as Swiss, London, Baby, sky blue particularly in topaz and greens, and blues of different tones/shades in sapphire, quartz, cubic zirconia, quartz and the like.

Similarly, if the crystals are coated with colorant iron and toner titanium then yellow to reddish, yellow or pink of varying tones/shades yellow crystals can be produced. Like wise using praseodymium, neodymium, tin and or the like as a toner with the colorant iron a range of yellow, or orange, or red colors can be induced in topaz, quartz, cubic zirconia, sapphire and or the like crystals.

A wide range of treatment conditions after deposition of atomically mixed films can be employed in the practice of present invention. Typically, conditions suitable to impart colors to crystals comprise subjecting the film-coated crystals to a heat treatment to a temperature in the range of about 700 degree Celsius up to about 1060 degree Celsius, for a time period in the range of about 30 minutes up to about 90 minutes. Normally, air or oxygen is employed as environment during heat treatment at ambient pressure. However, the film-coated crystals can optionally be subjected to an inert or a reducing atmosphere during heat cycle. For inert environment, nitrogen or argon or helium gases and the like can be used. Like wise for reducing-environment forming gas (a mixture of nitrogen-hydrogen) and the like is used. The heat treatment of coated crystals can also be carried out in vacuum to employ a non-oxidizing or a non-reducing ambient. The ambient conditions immensely affect the color saturation, intensity and fire of the treated crystals. Therefore, a suitable environment is employed during heat treatment to obtain the desired results.

While crystals can be used in the invention treatment methods without any special pre-treatment, it is presently desired that crystals employed in the practice of the invention be cleaned prior to deposition of the film. This is recommended here to only to remove grease or dust particles or the foreign contaminants from the surface of the crystals. Suitable cleaning methods are well known to those of skill in the art, and include washing in water, organic media, and the like.

Normally, long exposure times and/or high exposure temperatures enhance intensity and saturation of imparted color. However, either of these parameters at their increased value may cause cracks or breakage in crystals particularly if the untreated ones contain hidden defects. Since according to present invention, single film of atomically mixed materials in element form need optimum minimum temperature for diffusion and employs significantly low exposure times, the breakage problem has significantly reduced by the invented methods.

The colored crystals obtained after the treatment, according to the present invention do not require any physical or chemical cleaning and can be used directly as gemstones or for ornamental or decorative applications immediately after the treatment. As an example, one cycle of treatment needs about 12 hours to complete in the present invention methods.

In accordance with another embodiment of the present invention, the method employs atoms of a color-imparting and a toner, elements either diffuse from the film material into the surface thereof or chemically, get bonded to the surface atoms of the crystal. The diffused atoms of the color imparting and toner elements penetrate into the crystal and became a part of the crystal structure while in case when these atoms get chemically bonded to the surface atoms of the crystal, a transparent color film is formed over the crystal surface.

Color imparting and toner materials contemplated include the elemental materials described hereinabove.

In accordance with yet another embodiment of the present invention, the skin depth of the surface of the said crystal/gemstone has chemically bonded there to both color-imparting and toner elements in the film of atomically mixed materials. The color-imparting film materials contemplated include the materials described hereinabove. The color toner materials in film contemplated include the materials described hereinabove.

The method employs three basic steps: Cleaning Process; Film Deposition; General Treatment Protocol.

Cleaning process: Crystals treated in accordance with the present invention are cleaned as follows. First, dry air is blown over the polished crystals to remove particles of dust and the like and then cleaned thoroughly in organic solvents selected from acetone, tri-chloro-ethylene, and methanol to remove grease/oil trace from the surface thereof. Subsequently, the cleaned crystals are dried in an oven in clean air ambient.

Film deposition process: Clean dry crystals are coated with an atomically mixed thin film of an appropriate combination of colorant and color toner materials. Any one of the conventional techniques known in thin film technology such as physical vapour deposition, or chemical vapour deposition or chemical solution/s based one, and the like can be employed to coat an atomically mixed film of desired elemental materials on the crystals/gemstones. Atomic mixing of the elemental materials is done during the process of film deposition.

General treatment protocol: To impart color in crystals/gemstones, an atomically mixed materials film coated stones are placed in a suitable vessel, which can withstand the heat treatment temperatures contemplated for use. A ceramic tray, or a plate and the like can be used as a vessel. The vessel containing coated stones is placed in a furnace capable of attaining and accurately maintaining temperatures in the range of about 700 degree Celsius up to about 1100 degree Celsius. The desired gas is flow is maintained into the furnace to obtain the desired environment and the furnace is then heated to the desired temperature and maintained at that temperature for the desired period. Once the desired dwell time and temperature requirements, to obtain the desired color of desired tone/shade are satisfied, the furnace is cooled down and the vessel containing crystals/gemstones is taken out of the furnace.

The invention will now be described in a greater detail with reference to the following non-limiting examples.

Treatment of Cubic Zirconia: Cubic Zirconia (CZ) crystals are coated with an atomically mixed film of titanium and iron to achieve a variety of colors. Heat treatments of these stones in a temperature range of 700 degree Celsius to 750 degree Celsius in air for a time period in the range of 30 minutes to 60 minutes to impart yellow, orange, reddish yellow to red to the crystals. When heat treatment is carried out in oxygen ambient then proportion of yellow increases in comparison to reddish shed in the stones. Similarly, using an appropriate proportion of iron-praseodymium in the atomically coated film can also produce pink and chocolate colored CZ.

To produce black to brown colors in CZ stones, an atomically mixed film of iron and cobalt is employed. In this case heat treatments in the temperature range of 700 degree Celsius up to 800 degree Celsius in air/oxygen, is performed for dwell time between 30 minutes to 80 minutes.

To obtain green color of a variety of shades in CZ, a combination, comprising chromium-titanium is used in the film and heat treatments in temperature range of 900 degree Celsius up to 980 degree Celsius in air or oxygen ambient for 30 minutes to 90 minutes is employed. Similarly to produce greenish-blue to blue colors in CZ an appropriate combination of chromium-cobalt in the film are used for in the above heat treatment cycle.

Treatment of Quartz: To produce yellow to red, black to brown and a variety of green-blue shades in quartz crystals above described methods for coloring CZ can be employed.

Treatment of Topaz: Topaz crystals are coated with an atomically mixed film of cobalt and titanium to achieve a variety of colors. Heat treatments of these stones in a temperature range of 950 degree Celsius to 1050 degree Celsius in air for a time period in the range of 30 minutes to 90 minutes to induce light blue to dark blue in the stones. When these crystals are heated in temperature range of 880 degree Celsius to 980 degree Celsius for a dwell time in the range of 30 minutes to 90 minutes light green to dark green color is induced in the stones. If the treatment is carried out in nitrogen or a reducing gas ambient intensity of the color in crystals can be varied. Similarly, the use of oxidizing ambient during heating alters the intensity of green colors in stones.

The coating of cobalt-chromium combination in the film and heating them in air at temperature range of 1030 degree Celsius up to 1050 degree Celsius for a time about 80 minutes imparts commercially popular colors such as London, Swiss, Baby, and sky blue (otherwise obtained only by radiation techniques) to topaz crystals.

An atomically mixed film of titanium and iron on the topaz stones and heating them in a temperature range of 700 degree Celsius to 750 degree Celsius in air for a time period in the range of 30 minutes to 60 minutes induces yellow, orange, reddish yellow to red colors in the crystals. When heat treatment is carried out in oxygen ambient then proportion of yellow increases in comparison to reddish shed in the stones. Similarly, using an appropriate proportion of iron-praseodymium in the atomically coated film can also produce pink and chocolate colored topaz.

To produce imperial colors similar to that of naturally occurring topaz, an atomically mixed film of iron-titanium is coated on topaz and heated at a temperature in the range of 700 degree Celsius up to 880 degree Celsius in oxygen for 30 minutes. A heat treatment for 30 minutes up to 60 minutes in air gives colors ranging from imperial to reddish imperial.

To produce black to brown colored topaz, an atomically mixed film of iron and cobalt is employed. In this case, heat treatments in the temperature range of 700 degree Celsius up to 800 degree Celsius in air/oxygen is performed for dwell time between 30 minutes to 80 minutes.

Treatment of Sapphire: Sapphire is subjected to the same methods as described in the treatment of Topaz. However, care should be taken in employing heating cycle, particularly, the treatment temperature to which the stones are subjected to avoid damage. The color induction in sapphire is like that in topaz i.e. dark blue to light blue, or dark green to light green or a mixture of blue and green, or light yellow to dark yellow depending on the film thickness and heat cycle employed for the treatment.

Treatment for multicolored crystals: To produce multi colored (bi-colored or tri-colored) crystals, firstly, a portion of the crystal is masked for film deposition. The unmasked portion of the crystal is coated with an atomically mixed film of a desired combination of colorant and toner elements. The masking is then removed from the first portion of the crystal and another masking is already coated part of the stone. Now a different combination of elemental film, capable of causing different color is coated. The mask is removed after film deposition and stones are heated using an appropriate treatment cycle to induce desired colors. Thus masking and deposition for two times are employed to produce bi-colored stones. To produce tri-colored crystals. Similarly, three masking followed by depositions of three combinations of materials are needed. However, the combination of film materials for different deposition is selected such that all are capable of imparting colors at one temperature selected for heat treatment. Thus in this approach, by increasing the number of masking and film deposition cycles, we can produce multi colored crystals.

For example, if half part of a crystal is coated with cobalt-titanium combination and rest with an atomic mix of cobalt-iron film a bi-color crystal blue-yellow is obtained after heat treatment at 980 degree Celsius for 80 minutes. Colors of multi-colored crystals are determined by the combination used in film deposition. Thus a variety of multi-colored crystals can be obtain by an appropriate selection of combinations of colorant and toner materials and employing the suitable heat treatment cycle.

The foregoing description of the specific embodiments will so filly reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A method for producing color in a crystal, comprising the steps of:

(a) depositing onto the crystal an atomically mixed single film comprising atoms of two or more metals by physical or chemical vapor deposition, one of the metals selected to impart color to the crystal, and the other one or more selected for color shading effect; and (b) heating the film-coated crystal to cause atoms in the film to diffuse into the crystal simultaneously from the single atomically mixed film.

2. The method of claim 1, wherein the crystal is one of topaz, quartz, cubic zirconia (CZ), or sapphire.

3. The method of claim 1, wherein the crystal is cleaned before deposition of the film.

4. The method of claim 1 wherein the film deposited is varied in thickness depending on the intensity of color desired to be imparted to the crystal.

5. The method of claim 1, wherein the amount of the metal selected for color shading effect is varied in the atomically mixed film to obtain a desired shade of the color in the crystal.

6. The method of claim 1, wherein the metals diffused into the crystal are incorporated into the lattice structure of the crystal.

7. The method of claim 1, wherein the metals are chemically bonded onto the surface of the crystal.

8. The method of claim 1, wherein the metals are selected from the group including cobalt, iron, chromium, nickel, titanium, praseodymium, iridium, platinum, tin, vanadium, antimony, cadmium, silicon, zirconium, magnesium, zinc, palladium, erbium, neodymium, silver, copper, germanium, molybdenum, niobium, tantalum, manganese, zinc, molybdenum, and gold.

9. The method of claim 1 wherein for CZ, quartz, topaz, or sapphire crystals, the metal selected for imparting color is iron and metals selected for color shading effect are titanium and silicon, and wherein the coated crystal is heated at a temperature in the range of 700 degree Celsius to 950 degree Celsius in air/oxygen for 60 minutes to induce yellow, imperial, pink, chocolate, reddish yellow to red colors depending on the temperature and time employed during the treatment cycle.

10. The method of claim 1, wherein for CZ, quartz, topaz, or sapphire crystals, the metal selected for imparting color is iron and the metal selected for color shading effect is praseodymium, and wherein the coated crystal is heated at a temperature in the range of 700 degree Celsius to 750 degree Celsius in air/oxygen for 60 minutes to impart imperial to yellow colors depending on the temperature and time employed during the treatment cycle.

11. The method of claim 1, wherein for quartz, topaz, or sapphire crystals, the metal selected for inducing color is cobalt and the metal selected for color shading effect is iron, wherein the coated crystal is heated at a temperature in the range of 700 degree Celsius to 850 degree Celsius in air/oxygen for a time in the range of 30 minute to 60 minutes to induce black to brown colors depending on the temperature and time employed during the treatment cycle.

12. The method of claim 1, wherein for quartz, topaz, or sapphire crystals, the metal selected for inducing color is cobalt and the metal selected for color shading effect is titanium, wherein the coated crystal is heated at a temperature in the range of 900 degree Celsius to 980 degree Celsius in air/oxygen for a time in the range of 30 minutes to 80 minutes to induce light green to dark green colors depending on the temperature and time employed during the treatment cycle.

13. The method of claim 1, wherein for quartz, topaz, or sapphire crystals, the metal selected for inducing color is cobalt and the metal selected for color shading effect is titanium, wherein the coated crystal is heated at a temperature in the range of 1000 degree Celsius to 1060 degree Celsius in air/inert ambient for a time in the range of 30 minutes to 90 minutes to induce light blue to dark blue.

14. The method of claim 1, wherein for a topaz crystal, the metal selected for inducing color is cobalt and the metal selected for color shading effect is chromium, wherein the coated crystal is heated at a temperature in the range of 1030 degree Celsius to 1060 degree Celsius in air for a time in the range of 30 minutes to 90 minutes to induce London, baby, Swiss and sky blue colors.

15. The method of claim 1, wherein the crystal is one of CZ, topaz, sapphire, or quartz, and a single, atomically mixed film of iron and praseodymium is coated on a part of the crystal by masking the remaining part, and then by masking the coated part a single, atomically mixed film of cobalt and iron is deposited on the part that was masked first, and the coated crystal is heated at a temperature in the range of 1020 degree Celsius to 1060 degree Celsius in air for a time in the range of 30 minutes to 90 minutes to obtain a yellow-black bi-colored stone.

* * * * *